United States Patent [19]

Smith

[11] Patent Number: 4,903,965

[45] Date of Patent: Feb. 27, 1990

[54] POOL RACK

[76] Inventor: Franklin G. Smith, 2944 SE. Tibbetts, Portland, Oreg. 97202

[21] Appl. No.: 207,225

[22] Filed: Jun. 16, 1988

[51] Int. Cl.[4] ..... A63D 15/00

[52] U.S. Cl. ..... 273/22

[58] Field of Search ..... 273/22

[56] References Cited

U.S. PATENT DOCUMENTS

| | | | |
|---|---|---|---|
| 916,193 | 3/1909 | Pierce | 273/22 |
| 1,052,461 | 2/1913 | Chase | 273/22 |
| 1,089,140 | 3/1914 | Madigan | 273/22 |
| 2,405,677 | 8/1946 | Volpe | 273/22 |
| 2,422,939 | 6/1947 | Volpe | 273/22 |
| 3,253,826 | 5/1966 | Cook | 273/22 |
| 3,863,919 | 2/1975 | Sardelli | 273/22 |
| 4,469,328 | 9/1984 | Pacitti | 273/22 |
| 4,553,750 | 11/1985 | Kintz | 273/22 |
| 4,591,051 | 5/1986 | Rowman | 273/22 |

*Primary Examiner*—T. Brown

*Attorney, Agent, or Firm*—Klarquist, Sparkman, Campbell, Leigh & Whinston

[57] ABSTRACT

A pool rack comprising an equilateral triangular-shaped frame having upstanding walls and a flange extending outwardly from the top of the frame for facilitating lifting the rack from around a group of pool balls. The rear wall of the rack, located directly opposite the apex formed by two side walls of the rack, comprises leaf-type springs molded as an integral part of the frame. The frame, including the springs is made of a resilient high-memory material. A push buttons is inserted through the springs and attaches to a push bar positioned along the rear wall. The push bar is urged against the balls by manual operation of the push buttons and is biased back toward the rear wall by the springs.

10 Claims, 1 Drawing Sheet

POOL RACK

BACKGROUND OF THE INVENTION

The present invention relates to a pool rack for arranging pool balls on a pool table, and in particular, to a pool rack for arranging the balls in a compact triangular group.

At the beginning of a game of pool, a plurality of pool balls are tightly grouped near one end of a pool table using a triangular-shaped rack. The rack is removed and a player starts play by hitting a cue ball into the group to "break" or scatter the balls on the pool table. To maximize the scattering effect, it is desirable to rack the pool balls in as compact a group as possible, without spacing between the balls. For easy placement of the balls into the rack, however, the rack must be somewhat oversized, which creates a need to "tighten" the group of balls before the rack is removed.

Various methods for tightening a group of racked pool balls have been used. Traditionally, the pool racker's thumbs or fingers are used to push the back row of balls toward the apex of the triangular frame, thereby tightening the group. The thumbs, however, often apply uneven pressure to the balls, tightening some balls adequately but leaving spaces between others. The thumbs can also stick to the balls and cause them to separate from the once-tightened group. The thumbs may also be removed in an uneven manner, causing some of the balls to loosen. The conventional rack itself can also loosen a group of racked balls if the rack is removed carelessly from the racked group.

Various mechanical devices have been suggested to tightly rack the balls. For example, oversized racks with tubular members for rolling against the back row of balls have been suggested for tightening the group. Such racks are typified by those shown in Volpe U.S. Pat. No. 2,442,939 and Volpe U.S. Pat. No. 2,405,677. However, such racks lack any means for keeping the tubular member in a position away from the group of balls when it is not in use, making such racks difficult to remove from a racked group without disturbing the group. Such racks also contain features that are difficult to manufacture and assemble.

Other oversized pool racks have been suggested for racking pool balls into a tight group by having a spring-loaded bar biased away from the group for selectively pushing the balls into a tight group. Such racks are exemplified by Cook U.S. Pat. No. 3,253,826; Chase U.S. Pat. No. 1,052,461; and Pierce U.S. Pat. No. 916,193. Such racks, however, are typically made up of many separate and complex parts which complicate their manufacture, assembly, and use. These multiple parts also add to the size and weight of the pool rack, making them difficult to store and transport. A further drawback of such racks is that their complexity increases the likelihood of malfunction.

Accordingly, there is still a need for a pool rack that will tightly rack a group of pool balls in a simple and foolproof manner and without the aforementioned problems.

A primary objective of the present invention is therefore to provide an improved pool rack capable of consistently tightly racking a group of pool balls without being dependent on the racker's manual skills.

Another objective is to provide a pool rack which has few mechanical features capable of failing.

Still another objective is to provide a pool rack which is simple and inexpensive to manufacture and assemble.

Another objective is to provide a pool rack which is easy for unskilled pool players to use.

Another important objective is to provide a pool rack which is lightweight and has minimal external features to facilitate storage and transportation.

SUMMARY OF THE INVENTION

The present invention is a pool rack comprising an equilateral triangular-shaped frame having upstanding walls and a flange extending outwardly from the top of the frame for facilitating lifting the rack from around a group of pool balls. The rear wall of the rack, located directly opposite the apex formed by two side walls of the rack, comprises leaf-type springs molded as an integral part of the frame. The frame, including the springs is made of a resilient high-memory material. A push means, which may be comprised of push buttons, is inserted through the springs and attaches to a push bar positioned along the rear wall. The push bar is urged against the balls by manual operation of the push buttons and is biased back toward the rear wall by the springs.

DETAILED DESCRIPTION OF THE PREFERRED EMBODIMENT

Figure 1:
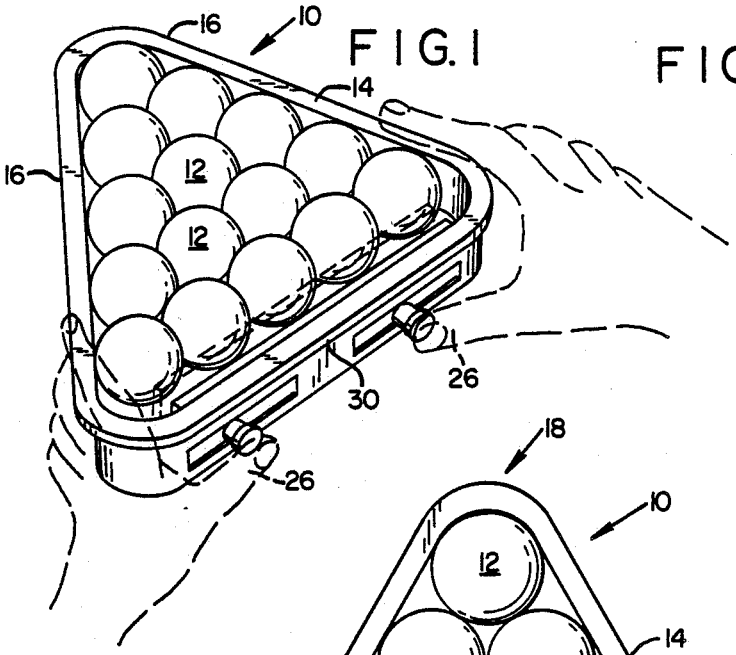
FIG. 1 is a perspective view of a pool rack in accordance with the present invention showing placement of a user's hands for manual operation to tighten a group of pool balls into a compact group.
Figure 2:
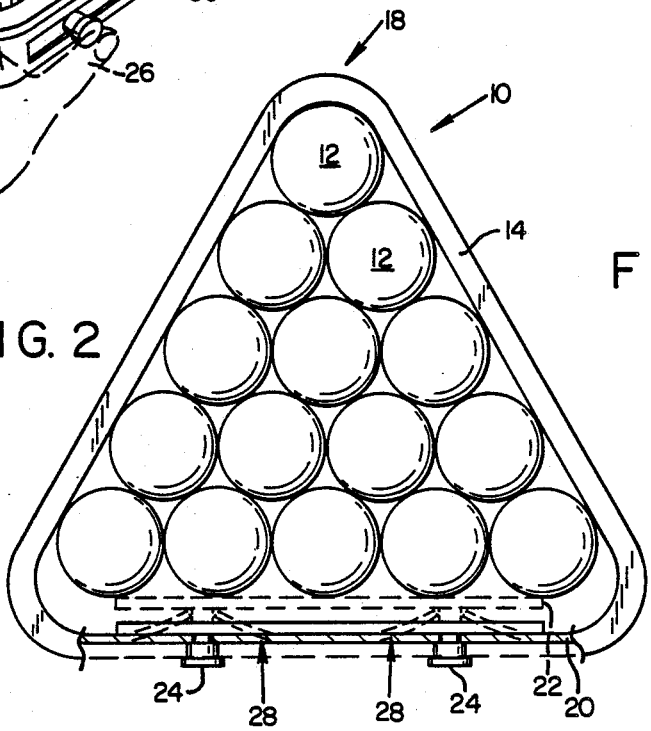
FIG. 2 is a top view of the pool rack in accordance with the present invention, showing a push bar in both an extended position (dashed lines) and a stored position.
Figure 3:
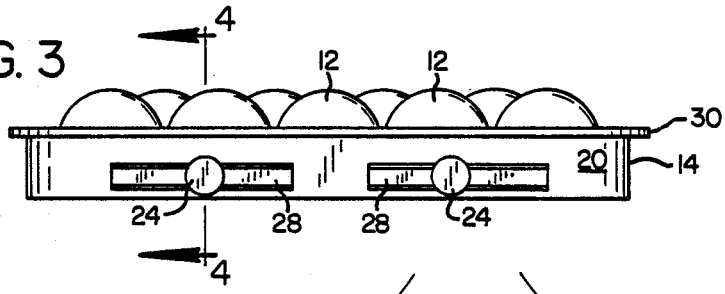
FIG. 3 is a rear elevational view of the pool rack in accordance with the present invention.

FIGS. 1-3 show a pool rack 10 in accordance with the present invention which is used to arrange and tighten a plurality of pool balls 12 on the surface of a pool table (not shown). In general, the pool rack 10 comprises a triangularly-shaped frame 14, which is slightly oversized to easily accommodate the balls 12. The frame consists of a pair of side walls 16 which are joined together near the apex 18 of the triangularly-shaped frame 14. The frame 14 further includes a rear wall 20 which is connected at its ends to the side walls 16.

A push bar 22 is positioned within the frame 14 parallel to the rear wall 20. The push bar 22 is used to urge the balls 12 towards the apex 18 of the frame 14 to create a tight group. A pair of push buttons 24 are attached to the push bar 22 and extend to the outside of the rear wall 20. In use, a player positions his or her thumbs 26 on the push buttons 24 and applies force to urge the push bar 22 into an extended position against the balls 12. The player's fingers are generally positioned along the side walls 16 of the frame 14 to hold and position the pool rack 10, as shown in FIG. 1. After tightening the balls 12, thumb pressure 26 is removed from the push buttons 24 and a pair of leaf springs 28 bias the push bar 22 back into a stored position against the rear wall 20. The rack 10 may then be removed from around the balls 12. An outwardly extending flange 30 is provided along the top of the frame 14 for facilitating the handling and removal of the pool rack 10.

Figure 4:
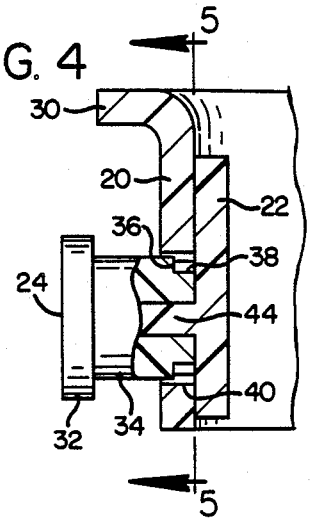
FIG. 4 is a partial cross-sectional view taken along line 4—4 of FIG. 3 showing the push means and push bar of the pool rack in accordance with the present invention.

As shown most clearly in FIG. 4, push button 24 comprises head 32, first shaft portion 34, shoulder 36 and second shaft portion 38. Apertures 40 are provided in the rear wall 20 of the frame, through which a part of the first shaft portion 34, shoulder 36 and second shaft portion 38 of the push buttons 24 are inserted. An axial bore 42, shown in FIG. 5, extends through a portion of the shaft of each push button 24. The push buttons are attached to a pair of pins 44 which extend perpendicularly from the push bar 22 and are molded as an integral part of the bar 22. Push buttons 24 are attached to the pins 44 by suitable means, such as press fit to simplify assembly.

Figure 5:
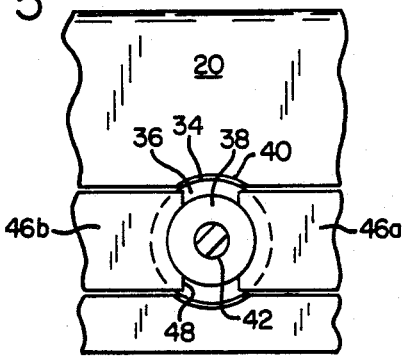
FIG. 5 is a partial side view of the push means of the pool rack in accordance with the present invention taken along line 5—5 of FIG. 4.

FIG. 5 shows a portion of the rear wall 20 which is integrally formed into springs 28. Each spring 28 consists of a pair of leaf springs **46*a* and 46*b*, which are formed from a portion of the rear wall 20. The frame 14 and the leafs 46*a* and 46*b* are formed of a resilient, high-memory plastic material. The leafs, which are generally thinner than the rest of the rear wall 20, may be easily deformed by exerting pressure on the push buttons 24 towards the balls, but then will return to their original position in the plane of the rear wall 20. When the leafs return to their original position, they are slightly recessed from the outer surface of the rear wall by virtue of their "thinner" profile (as is apparent from FIGS. 4 and 6**). The resilient material may be a plastic or similar material, such as Delrin resin produced by DuPont. Other suitable high-memory materials may also be used.

The ends 48 of the leafs **46*a* and 46*b* are concavely shaped to conform generally to the shape and the size of the second shaft portion 38 of the push button 24. The second shaft portion 38 is sized such that the ends 48 of the leafs are retained by the shoulder 36 and second shaft portion 38 of the push button 24**.

Figure 6:
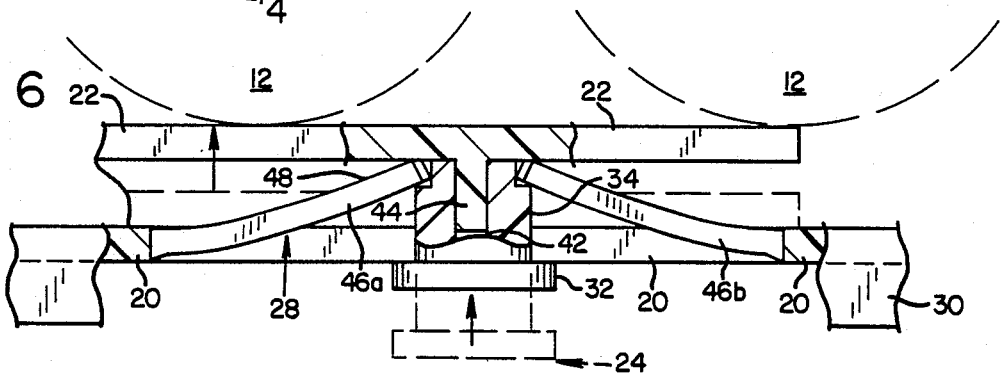
FIG. 6 is an enlarged cross-sectional top view of a portion of the rear wall of the pool rack in accordance with the present invention, showing the push bar and springs in the extended position.

In operation, which is seen most clearly in FIG. 6, the push buttons 24 are manually pushed toward the apex 18 of the rack 10, causing the springs 28 to deflect, while the push buttons 24 urge the push bar 22 into contact with the pool balls 12. When pressure on the push buttons is released, the spring leafs **46*a* and 46*b* push upon the shoulder 36 of the push buttons 24 to return the buttons to their original position so that the push bar 22 is returned to the stored position lying along the rear wall 20 of the frame 14**.

Having illustrated and described the principles of the invention by the preferred embodiment, it should be apparent to those persons skilled in the art that the illustrated embodiment may be modified without departing from such principles. I therefore claim as my invention not only the illustrated embodiment, but all such modifications, variations and equivalents thereof as come within the spirit and scope of the following claims.

I claim:

1. A pool rack apparatus for grouping pool balls on a pool table into a tight triangular shape comprising:

an equilateral triangular-shaped frame with upstanding walls including a rear wall and opposite side walls extending from said rear wall and merging at an apex of said frame, the frame being sized to enclose and loosely group the balls;

a push bar extending inside and along the rear wall;

spring means for resiliently mounting said push bar to said rear wall and biasing said push bar toward said rear wall, said spring means comprising leaf-type spring means forming an integral portion of said rear wall; and push means for manually extending said push bar away from said rear wall and toward the apex of said frame in opposition to the spring means for engaging the balls to urge the group snugly against said opposite side walls and thereby into a tight triangular group.

2. The apparatus of claim 1 wherein the rear wall comprises a resilient high-memory plastic material.

3. The apparatus of claim 1 wherein said push means comprises a plurality of manually actuated push buttons passing through said spring means and attaching to said push bar for extending said push bar in opposition to said spring means.

4. A pool rack apparatus for grouping pool balls on a pool table into a tight triangular shape comprising:

an equilateral triangular-shaped frame with upstanding walls including a rear wall and opposite side walls extending from said rear wall and merging at an apex of said frame, the frame being sized to enclose and loosely group the balls;

a push bar extending inside and along the rear wall;

spring means for resiliently mounting said push bar to said rear wall and biasing said push bar toward said rear wall, said spring means being integral with said rear wall;

push means for manually extending said push bar away from said rear wall and toward the apex of said frame in opposition to the spring means for engaging the balls to urge the group snugly against said opposite side walls and thereby into a tight triangular group;

the rear wall comprising a resilient high-memory plastic material and said spring means comprising leaf-type spring means forming part of the rear wall;

the leaf-type spring means comprising two pairs of leaves spaced apart along the rear wall and capable of flexing inwardly from their junctures with the remainder of the rear wall to urge the push bar toward the balls.

5. The apparatus of claim 4 wherein the push means includes connector means for interconnecting the free ends of the leaves of a pair to the push bar.

6. The apparatus of claim 4 wherein the leaves of a pair define an aperture therebetween for receiving the push means whereby the leaves are connected to the push bar.

7. A pool rack apparatus for grouping pool balls on a pool table into a tight triangular shape comprising:

an equilateral triangular-shaped frame with upstanding walls including a rear wall and opposite side walls extending from said rear wall and merging at an apex of said frame, the frame being sized to enclose and loosely group the balls;

a push bar extending inside and along the rear wall;

spring means for resiliently mounting said push bar to said rear wall and biasing said push bar toward said rear wall, said spring means being integral with said rear wall;

push means for manually extending said push bar away from said rear wall and toward the apex of said frame in opposition to the spring means for engaging the balls to urge the group snugly against said opposite side walls and thereby into a tight triangular group; and said spring means comprising an integrally molded portion of said rear wall, wherein the rear wall comprises a resilient plastic material.

8. A pool rack apparatus for grouping pool balls on a pool table into a tight triangular shape comprising:

an equilateral triangular-shaped frame with upstanding walls including a rear wall and opposite side walls extending from said rear wall and merging at an apex of said frame, the frame being sized to enclose and loosely group the balls;

a push bar extending inside and along the rear wall;

spring means for resiliently mounting said push bar to said rear wall and biasing said push bar toward said rear wall, said spring means being integral with said rear wall;

push means for manually extending said push bar away from said rear wall and toward the apex of said frame in opposition to the spring means for engaging the balls to urge the group snugly against said opposite side walls and thereby into a tight triangular group; and said spring means comprising pairs of leaf springs having free ends defining openings through which said push means is inserted for attaching to said push bar.

9. A pool rack apparatus for grouping pool balls on a pool table into a tight triangular shape comprising:

an equilateral triangular-shaped frame with upstanding wall including a rear wall and opposite side walls extending from said rear wall and merging at an apex of said frame, the frame being sized to enclose and loosely group the balls;

a push bar extending inside and along the rear wall;

spring means for resiliently mounting said push bar to said rear wall and biasing said push bar toward said rear wall, said spring means being integral with said rear wall;

push means for manually extending said push bar away from said rear wall and toward the apex of said frame in opposition to the spring means for engaging the balls to urge the group snugly against said opposite side walls and thereby into a tight triangular group; and said spring means being recessed from the outer surface of said rear wall.

10. A pool rack apparatus for grouping pool balls on a pool table into a tight triangular shape comprising:

an equilateral triangular-shaped frame with upstanding walls including a rear wall and opposite side walls extending from said rear wall and merging at an apex of said frame, the frame being sized to enclose and loosely group the balls;

a push bar extending inside and along the rear wall;

spring means for resiliently mounting said push bar to said rear wall and biasing said push bar toward said rear wall, said spring means being integral with said rear wall;

push means for manually extending said push bar away from said rear wall and toward the apex of said frame in opposition to the spring means for engaging the balls to urge the group snugly against said opposite side walls and thereby into a tight triangular group; and said frame including laterally outwardly extending flange means providing a lifting means for lifting said frame from said tight triangular group of pool balls.

* * * * *